US006834682B2

(12) United States Patent
Jenner et al.

(10) Patent No.: US 6,834,682 B2
(45) Date of Patent: Dec. 28, 2004

(54) SET OF HAND HELD DEVICES

(76) Inventors: Carolyn Kaye Jenner, P.O. Box 864, Nerang, QLD (AU), 4211; Dale Alexander Jenner, P.O. Box 864, Nerang, QLD (AU), 4211

( * ) Notice: Subject to any disclaimer, the term of this patent is extended or adjusted under 35 U.S.C. 154(b) by 7 days.

(21) Appl. No.: 10/062,524

(22) Filed: Feb. 5, 2002

(65) Prior Publication Data

US 2002/0153050 A1 Oct. 24, 2002

Related U.S. Application Data

(60) Provisional application No. 60/267,484, filed on Feb. 9, 2001.

(51) Int. Cl.[7] ..... D03D 29/00

(52) U.S. Cl. ..... 139/29; 139/33; 66/1 R; 38/102.9

(58) Field of Search ..... 139/29, 33, 30; 66/1 R, 1 A, 1.5, 2, 3, 4, 5; 38/102, 102.9, 102.91

(56) References Cited

U.S. PATENT DOCUMENTS

| | | | | | |
|---|---|---|---|---|---|
| 3,054,277 | A | * | 9/1962 | Broschard | 66/1 A |
| 4,077,436 | A | * | 3/1978 | Kliot | 139/34 |
| 4,158,296 | A | * | 6/1979 | Dunlop | 66/4 |
| 4,417,409 | A | * | 11/1983 | Bell | 38/102.91 |
| 6,186,912 | B1 | * | 2/2001 | Gait | 473/513 |

* cited by examiner

*Primary Examiner*—John J. Calvert
*Assistant Examiner*—Robert H. Muromoto, Jr.

(57) ABSTRACT

Portable looming templates for creating fabric from yarn. Square templates with a series of indentations around the perimeters. The templates are divided into halves and held together with hinges. The looms have location holes to which are attached to a swinging arm. The arm has a location hole and a slot. They are held to the loom with suitable fasteners. When required the arm swings free to allow the halves of each loom to fold together releasing the fabric.

10 Claims, 3 Drawing Sheets

SET OF HAND HELD DEVICES

Figure 1:
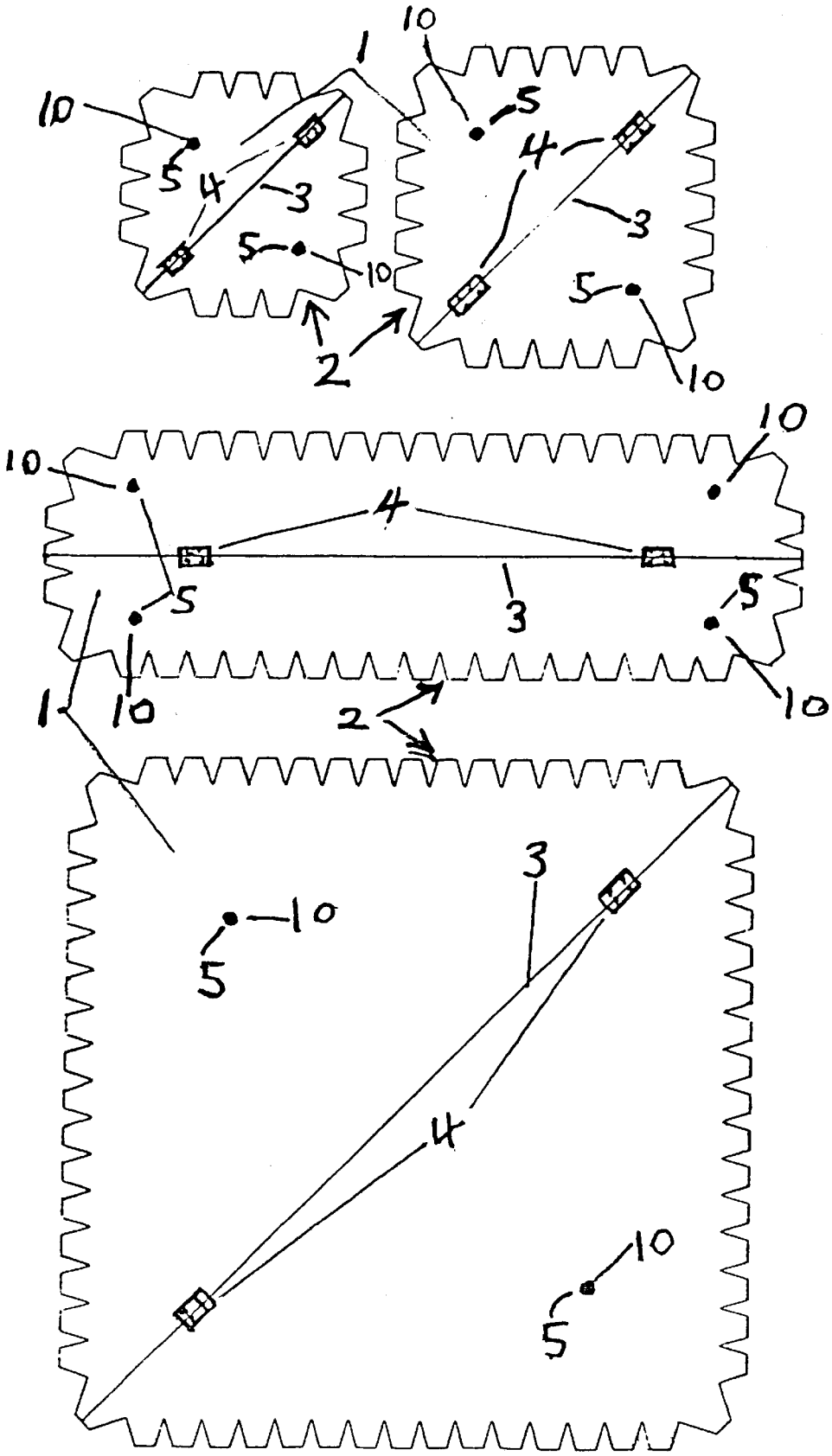

This application claims the benefit of Provisional application 60/267,454 filed on Feb. 9, 2001.

This present invention relates to a set of Hand Held Devices for weaving and creating squares and rectangles of fabric from yarn, other than knitting or crocheting Hand weaving is a popular hobby. Articles such as Afghan rugs, throws, jackets, bags, coathanger covers, cushion covers, doilies, mats and many more items can be woven on these Hand Held Devices, and because of the small size of the devices they can be taken and used anywhere. Weaving with these Hand Held Devices is very easy and can be used by School children through to the mature crafter. The present invention possesses a number of significant advantages over prior types of Hand Looms and one feature being that these Looms can be used by Occupational and Diversional Therapists as therapy for their patients.

Many years ago there was a craft where nails were hammered into a wooden frame, and yarn was wrapped around the nails in a systematic fashion to create pieces of woven fabric. To remove the woven fabric from the frame, the loops formed around the nails had to be cut off with scissors, effectively limiting the scope of the usefulness for the pieces of fabric.

These problems have been overcome by a further feature of the present invention which provides Hand Held Devices, that are square or rectangular sheets of rigid material, with a series of indentations formed around the perimeters. These square or rectangular sheets are divided into equal halves diagonally or parallel to the edges. The two halves of the square or rectangular Hand Held Devices are joined together with hinges or any flexible joint.

Swinging arms of suitable rigid material having a location hole at one end and a slot at the other are attached to the Hand Held Devices with suitable fasteners through location holes which are positioned at the appropriate places on the Hand Held Devices. These fasteners are of such a nature that they allow the arms to swing free at the slotted end when required.

The Hand Held Devices and swinging arms may be made from suitable material such as MDF or moulded plastic.

The fasteners may be made from any suitable material such as brass or moulded plastic.

The hinges may be made from any suitable material such as brass, or moulded plastic with any flexible joint.

This invention of Hand Held Devices enables yarn to be woven into fabric and released from the devices with the loops intact around the perimeter, ready to be stitched into garments, rugs, cushion covers and craft items.

Many people are unable to knit or crochet and these Hand Held Devices offer a novel way for those people who are looking for a simple craft method of turning yarn into fabric and product.

It will be apparent to those skilled in the art that many modifications and variations may be made to the embodiment described without departing from the scope of the invention.

To assist with understanding the present invention, reference will now be made to the accompanying drawings which show the set of Hand Held Devices.

In the Description of Drawings

FIG. 1 shows the front of the portable looming template (1), with a series of indentations around the perimeters (2).

The portable looming template is divided diagonally or parallel to the perimeter (3). They are secured together with suitable hinges (4), and have location holes (5), appropriately placed to accommodate fasteners (10).

Figure 2:
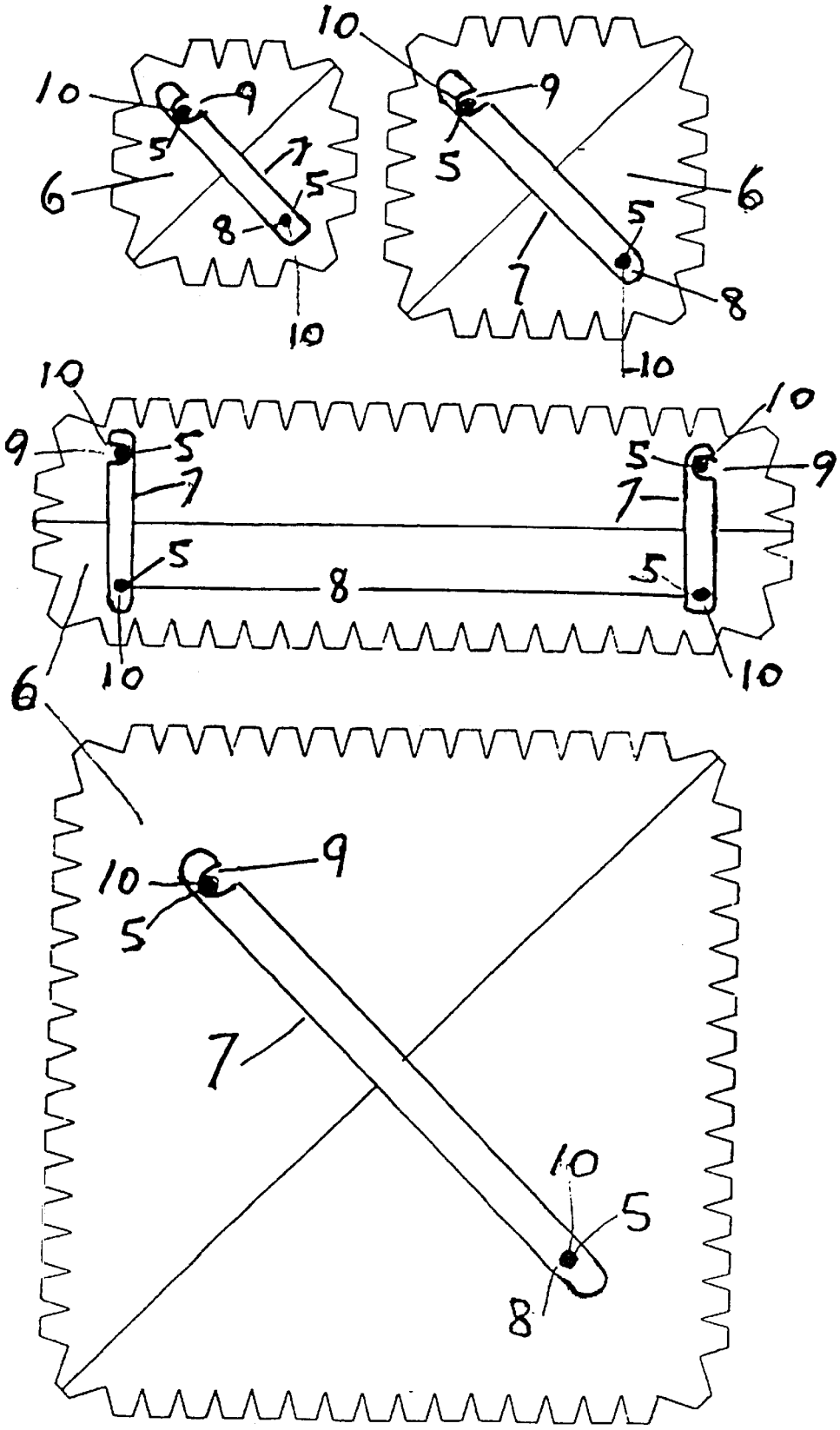

FIG. 2 shows the back of the portable looming template (6), with a swinging arm (7) at right angles to the halves. The swinging arm has a hole at (8) at one end and a slot at (9) at the other end. This hole (8) and slot (9) match with hole (5) in the portable weaving template and are attached to the template with appropriate fasteners (10).

Figure 3:
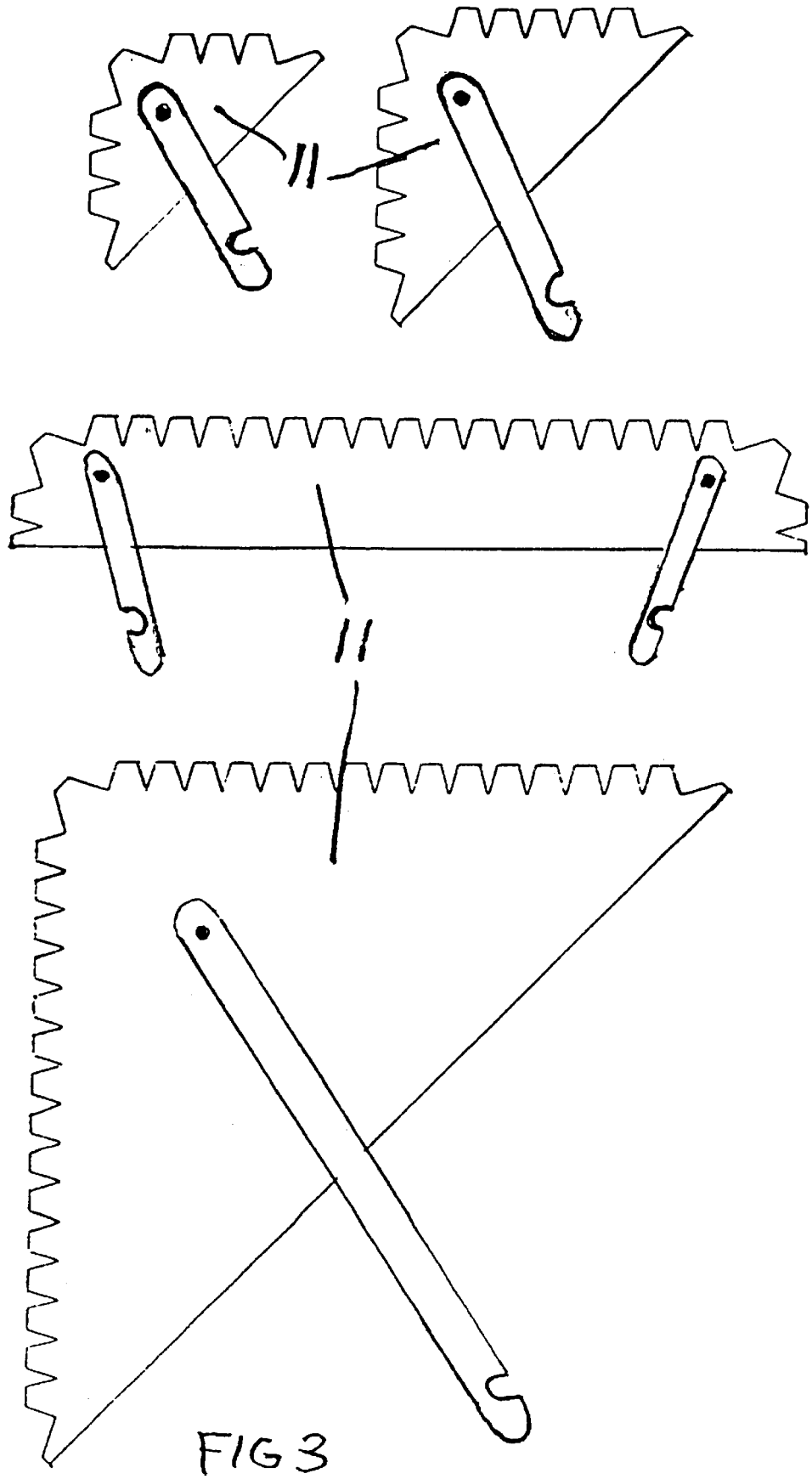

FIG. 3 shows the portable looming template folded together with arm released (11).

What is claimed is:

1. A set of square portable looming templates, which are used for making squares of fabric from yarn by winding yarn through notches on the frame of the template and then knotting at each intersection, and when completed folding the template together so that the square of fabric comes off the template in one piece enabling several squares to be stitched or crocheted together to make various items. The template comprises sheets of any suitable rigid material with a series of indentations formed around the perimeters; these sheets are divided into equal halves diagonally to the perimeter and held together with hinges on the front which allows the halves to fold together when required; to hold the templates open, swinging arms of suitable rigid material swing parallel to the plane of the square in the opened or unfolded orientation and are fastened to both halves at the back of the templates through appropriately placed holes, one end of the swinging arm is slotted to allow the arms to swing clear of the fasteners when required, allowing the two halves to fold together to release the fabric.

2. A set of square portable looming templates, of claim 1, wherein the series of indentations are comprised of any shape or configuration around the perimeter of said templates.

3. A set of square portable looming templates, of claim 1 or claim 2, wherein any suitable rigid material is medium density fiberboard.

4. A set of square portable looming templates, of claim 1 or claim 2, wherein any suitable rigid material is moulded plastic.

5. A set of square portable looming templates, of claim 1 or claim 2, wherein said halves are held together with brass butterfly hinges.

6. A set of square portable looming templates, of claim 1 or claim 2, wherein said halves are held together with any flexible joint.

7. A set of square portable looming templates, of claim 1 or claim 2, wherein the swinging arms are made of medium density fiberboard.

8. A set of square portable looming templates, of claim 1 or claim 2, wherein the swinging arms are made of moulded plastic.

9. A set of square portable looming templates, of claim 1 or claim 2, wherein the swinging arms are attached to the templates with suitable brass fasteners.

10. A set of square portable looming templates, of claim 1 or claim 2, wherein the swinging arms are attached to the templates with suitable moulded plastic fasteners.

* * * * *